United States Patent [19]

Weaver

[11] 4,132,213

[45] Jan. 2, 1979

[54] ROTARY ENGINE

[76] Inventor: R. Homer Weaver, 3525 Darby Rd., Havertown, Pa. 19041

[21] Appl. No.: 782,522

[22] Filed: Mar. 29, 1977

[51] Int. Cl.[2] ..... F01C 3/02; F02B 53/08

[52] U.S. Cl. ..... 123/236; 418/226

[58] Field of Search ..... 123/8.41, 8.45, 8.23, 123/8.39, 8.29, 44 R, 44 C, 44 D, 43 R; 418/225, 226, 227

[56] References Cited

U.S. PATENT DOCUMENTS

| | | | |
|---|---|---|---|
| 1,136,976 | 4/1915 | Reaugh | 418/226 |
| 1,263,639 | 4/1918 | Bertsch | 418/226 |
| 1,831,263 | 11/1931 | Ross | 123/8.45 |
| 2,228,184 | 1/1941 | Strite | 123/8.41 |
| 3,363,606 | 1/1968 | Robertson | 418/227 X |
| 3,867,075 | 2/1975 | Horst | 418/226 X |
| 3,951,111 | 4/1976 | Lester | 123/8.23 X |

*Primary Examiner*—Carlton R. Croyle
*Assistant Examiner*—Michael Koczo, Jr.
*Attorney, Agent, or Firm*—Frailey & Ratner

[57] ABSTRACT

A rotary engine having a power output shaft, a drive unit for rotating the shaft, the drive unit including a rotary drive element affixed to the shaft, and a stationary element for supporting the shaft rotatably. A pair of diametrically spaced, rotatable, paddle-like pistons are mounted on the rotary drive element. The paddle-like pistons rotate into and out of opposing, complementary cavities formed in the rotary drive element and in the stationary element. The complemental cavities function as revolving cylinders or chambers for the reception of a high pressure, expansible fluid. The expansible fluid drives the pistons to impart rotation to the rotary element, to drive the power output shaft. A source of high pressure expansible fluid is provided, together with a valve system connecting the fluid source to the drive unit. The valve system is automatically operative to discharge the fluid under high pressure into the drive unit chambers at periodic intervals. The source of high pressure fluid may comprise a compressor having a construction similar to that of the drive unit, for receiving and compressing a fuel and air mixture. The engine is adaptable to be utilized as a gasoline internal combustion engine, a diesel engine, a steam engine, or any other type of engine using high pressure, expansible fluids.

10 Claims, 6 Drawing Figures

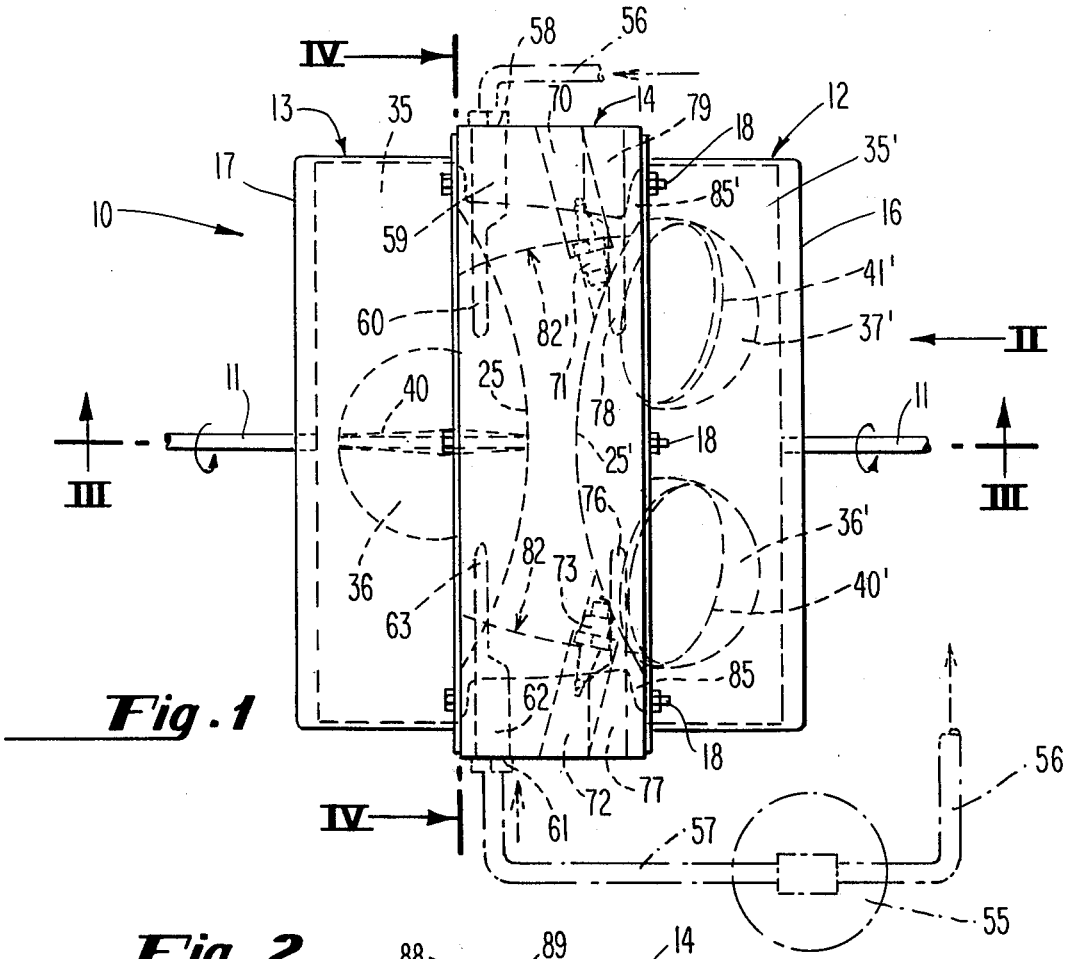
Fig. 1
Fig. 2
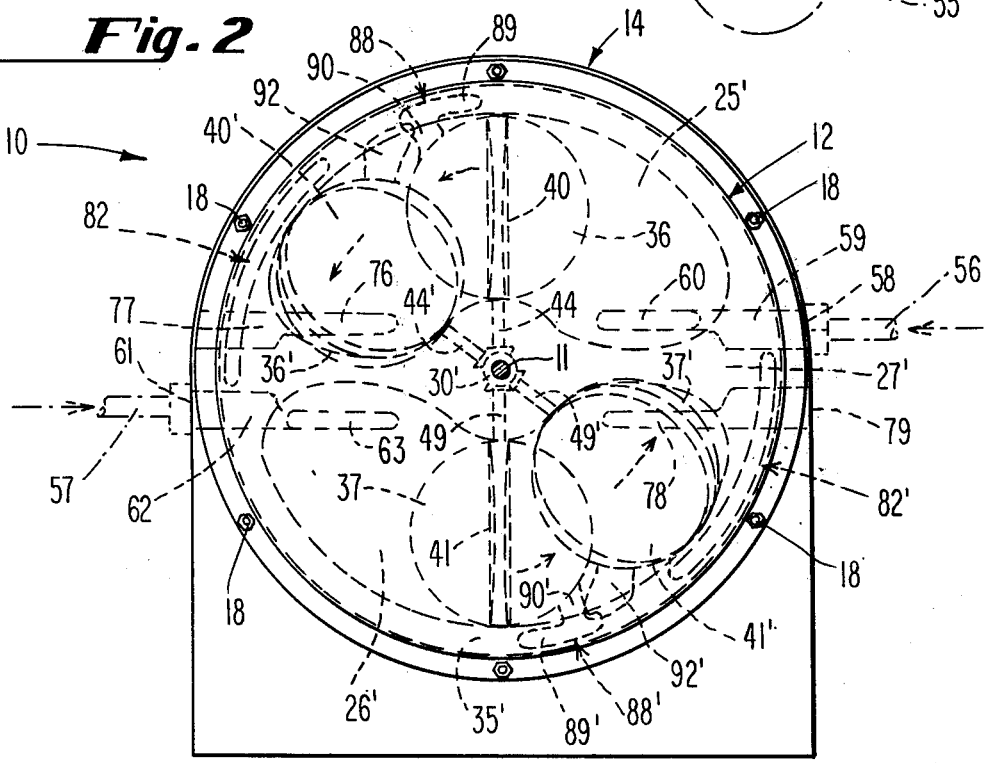

ROTARY ENGINE

BACKGROUND OF THE INVENTION

It long has been recognized that rotary engines of the internal combustion type are capable of achieving relatively high speed of rotation, while utilizing relatively minimum quantities of combustible fuels. Such engines utilize a minimum of moving parts, and in theory at least, are more efficient in operation than conventional engines. However, while a great deal of interest has been generated in developing and putting into use a commercially practical and acceptable rotary engine, endeavors in this direction have met with only limited success so far.

SUMMARY OF THE INVENTION

The primary object of this invention is to provide a new and improved rotary engine which incorporates a drive unit for rotating a power output shaft, which drive unit has only three moveable parts.

A further object of the invention is to provide a rotary engine which is adaptable for use as a gasoline internal combustion engine, or a diesel engine, or a steam engine.

A further object of the invention is to provide a new and improved rotary engine which is economical of manufacture, efficient in operation, and when used as an internal combustion engine, consumes only mininum quantities of combustible fuels.

A further object is to provide a rotary engine of the internal combustion type which is provided with its own compressor, for compressing fuel and air mixtures and delivering such mixtures periodically to the drive unit of the engine, the compressor element being driven from the power output shaft driven by the drive unit.

A further object is to provide a rotary engine having a drive unit for a rotatable power output shaft, which unit includes a rotary drive element, functioning also as a flywheel, to which rotation is imparted by means of rotatable or spinable paddle-like pistons supported rotatably by the rotary element. The pistons spin or rotate into and out of opposed, complemental cavities which provide revolving chambers for the reception of high pressure, expansible fluids. The fluids drive the pistons to impart rotation to the rotary drive element and to the rotatable shaft affixed thereto.

Other objects and advantages will be apparent from the following description of a preferred embodiment of a rotary engine incorporating this invention.

DESCRIPTION OF THE VIEWS OF THE DRAWING

FIG. 1 is a view in top plan showing a preferred rotary engine incorporating this invention.

FIG. 2 is a transverse view in elevation of the driver side of the engine, looking in the direction of the arrow II of FIG. 1.

DETAILED DESCRIPTION OF THE PREFERRED ENGINE OF THE INVENTION

Figure 3:
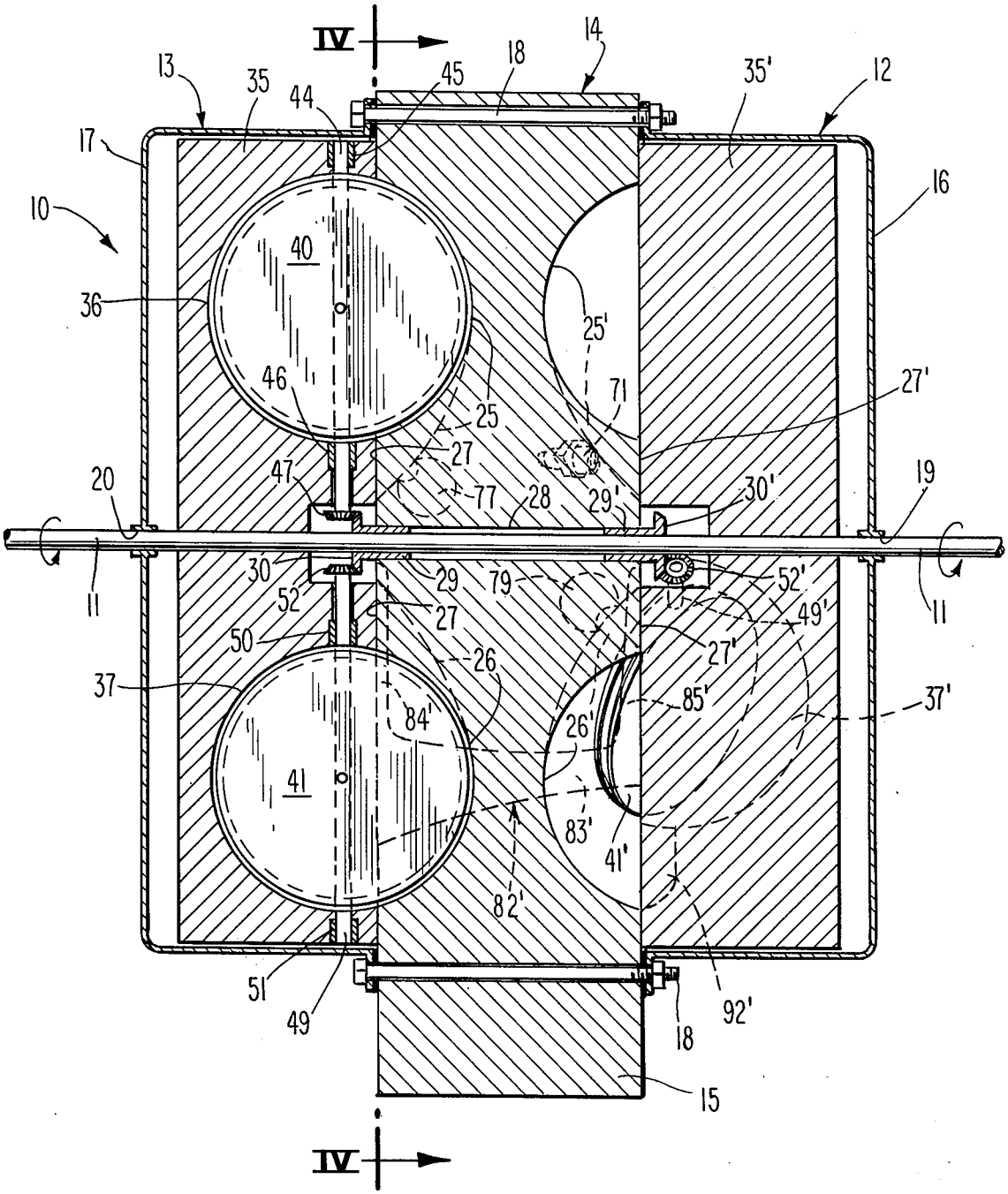
FIG. 3 is a longitudinal section taken as indicated by the arrows III—III of FIG. 1.

The engine 10 illustrated in FIGS. 1–5 of the drawing is an internal combustion engine of the gasoline type. The engine consists of a longitudinal power output shaft 11, a driver or drive unit 12, a compressor or compressor unit 13 and a stationary element 14. The stationary element 14 is disposed intermediate of the drive unit 12 and compressor unit 13, and is provided with a base 15 for support of the engine 10. The drive unit 12 imparts rotation to shaft 11, and the compressor unit 13 compresses the fuel and air mixture to the desired compression ratio, for delivery at periodic intervals to the driver 12.

Shaft 11 extends through axial passage 28 formed in stationary element 14 (FIG. 3), and is supported rotatably by element 14 by means of roller or other conventional bearings (not shown). Drive unit 12 is enclosed by a circular cover or casing 16, and compressor unit 13 is enclosed by a circular cover or casing 17. The two casings 16, 17 are secured firmly to opposite sides of the stationary element 14 by a plurality of bolts 18. Suitable gaskets or similar means interposed between flanges of the casings 16 and 17 and the outer surfaces of the stationary element 14 render the ensemble fluid-tight. Shaft 11 extends through apertures 19, 20 formed, respectively, in the casings 16, 17. The apertures 19, 20 may be provided with suitable bearings or seals (not shown) for shaft 11, by which the arrangement is rendered fluid-tight.

In the embodiment shown, the components of the compressor 13 are disposed angularly in advance of the corresponding components of the driver 12 by an arcuate distance or displacement on the order of 120°–130°.

Figure 4:
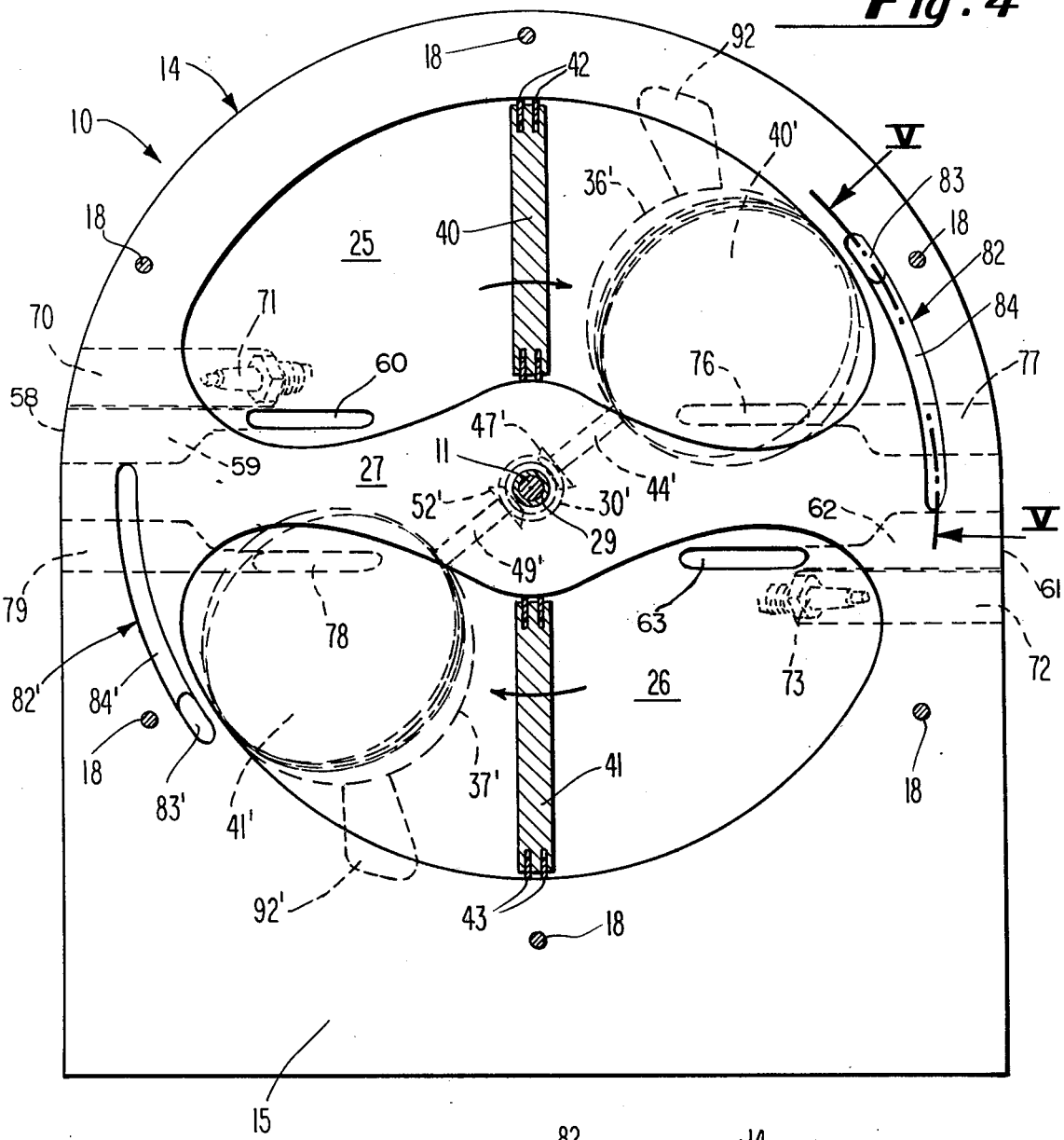
FIG. 4 is a transverse section taken as indicated by the arrows IV—IV of FIG. 1, and also by the arrows IV—IV of FIG. 3.

As best shown in FIG. 4, the compressor side of the stationary element 14 is provided with a pair of vertically spaced, somewhat kidney shaped, transverse cavities 25, 26. The two cavities 25, 26 are generally arcuate and relatively elongated, and are spaced diametrically relative to the intermediate shaft 11. They are relatively shallow adjacent their perimeters, and gradually increase in depth in the direction of their respective inner center portions (FIGS. 1, 3). The cavities 25, 26 are separated by a generally horizontal center portion or bar 27 through which shaft 11 and passage 28 pass. Affixed in the axial passage 28, and extending outwardly from the transverse center portion 27, is a hollow tubular element 29 having a bevel gear 30 affixed to its distal end (FIG. 3).

The compressor 13 includes a circular rotary compressor element 35 driven by shaft 11, to which it is affixed by any suitable means such as a key (not shown). Rotary element 35 functions also as a flywheel, and is disposed in opposing, fluid-tight relationship to the stationary element 14. Formed in the inner face of the rotary compressor element 35 is a pair of diametrically spaced circular cavities 36, 37 (FIG. 3), the inner or bottom portions of which are of generally hemispherical configuration. The flywheel cavities 36, 37 are disposed in opposing and communicating relation to the stationary cavities 25, 26 formed in element 14, and rotate relative thereto.

Mounted rotatably on the rotary compressor element 35 is a pair of diametrically spaced, rotatable paddle-like pistons 40, 41. One each of the pair of paddle pistons 40,

41 is mounted, respectively, in one of the circular flywheel cavities 36, 37. In the embodiment shown, the pistons are of generally circular configuration, to complement the outer circular configuraton of cavities 36, 37, and are provided with circumferentially mounted rings or seals 42, 43 (FIG. 4). The pistons 40, 41 are affixed, respectively, to spaced, co-axial radial shafts 44, 49 (FIG. 3) supported rotatably by rotary element 35. More specifically, piston shaft 44 is rotatably mounted on flywheel 35 by spaced bearings 45, 46, and shaft 49 is rotatably mounted thereon by spaced bearings 50, 51. The inner ends of the piston shafts 44, 49 are provided, respectively, with bevel gears 47, 52 which mesh with the stationary bevel gear 30 mounted on stationary element 14. Shaft 11 extends intermediate of the inner ends of the spaced radial piston shafts 44, 49.

When shaft 11 imparts rotational drive to the rotary compressor element 35, the latter rotates relative to the stationary element 14. The meshing engagement of piston bevel gears 47, 52 with the stationary bevel gear 30 imparts rotation to the piston shafts 44, 49, and to their respective paddle pistons 40, 41, as they revolve about the axis of the machine 10. By the arrangement shown, as the compressor element 35 rotates, the pistons 40, 41 rotate or spin successively into and out of the cavities 25, 26, 36, 37. The cavities are of complemental concave configuration, to provide suitable clearance, with minimum tolerance, for the revolving paddle-like pistons 40, 41 as the pistons rotate into and out of the cavities. The piston sealing means or rings 42, 43 are designed to ensure that a fluidtight relationship is maintained between the pistons and the internal surfaces of the cavities, as the pistons rotate. By reason of their complemental construction and communicable disposition, the rotary cavities 36, 37 on the one hand, and the stationary cavities 25, 26 on the other hand, together provide separate revolvable chambers or "cylinders" for the revolving and rotating pistons 40, 41, as compressor element 35 rotates.

Pistons 40, 41 are illustrated in the drawing as being rotationally oriented to penetrate fully into their respective cavities 36, 37. They thus are shown aligned longitudinally with the axis of the engine 10, with their radial shafts 44, 49 vertical. When the pistons 40, 41, upon further rotation of element 35, are oriented an additional 90° relative to their axes, they are disposed transversely of the engine 10, and their radial shafts 44, 49 are horizontal. In this latter position, the pistons are disposed entirely within the outer portions of their cavities 36, 37, and the other surfaces of the transversely disposed pistons are substantially flush with the adjacent inner face of the rotary compressor element 35. Preferably, a portion of the outermost arcuate areas of the pistons 40, 41, intermediate of their respective support bearings 46, 47 and 50, 52, taper inward slightly (FIG. 2) to facilitate the rotation of the pistons relative to the chambers provided by the cavities 25, 26, 36, 37.

While the pistons 40, 41 are illustrated in the drawing as being of circular configuration, such arrangement is not essential to the invention. Depending on the design of the engine, the purpose for which it is to be used and other factors, the configuration of the paddle-like pistons 40, 41, and the complemental configuration of their cavities 36, 37, may assume other forms, such as elliptic for example. In such event, the concave profiles of the complemental stationary cavities are suitably altered.

The rotatable, paddle-like pistons 40, 41 are operative to compress, to the necessary or desired compression ratio in their respective rotatable chambers, a gasoline and air mixture introduced from a carburetor 55 (FIG. 1) disposed externally of the engine 10, and connected thereto by means of conduits 56, 57. Conduit 56 is suitably connected to a port 58 formed in the outer wall of the stationary element 14, and providing egress to a conduit 59 which extends inwardly of element 14 and terminates in an elongated port 60 formed in the bottom of the stationary arcuate cavity 25 (FIG. 4). Similarly, conduit 57 is connected to port 61 for the inwardly extending conduit 62 formed in stationary element 14, conduit 62 terminating in an elongated port 63 formed in the bottom of the stationary arcuate cavity 26.

The construction of the components of the driver side 12 of the engine 10 is substantially identical to that of the compressor side 13. The driver side of the stationary element 14 is provided with a pair of vertically spaced, transversely extending, arcuate, somewhat kidney shaped cavities 25', 26' (FIG. 2). The stationary cavities 25', 26' are separated by a generally horizontal center portion 27', through which shaft 11 and passage 28 pass. Affixed in the axial passage 28, and extending outwardly from the transverse center portion 27', is a hollow tubular element 29' having a bevel gear 30' affixed to its distal end (FIG. 3).

The driver 12 includes a circular rotary drive element 35' which is affixed by any suitable means, such as a key (not shown), to the rotatable power output shaft 11, to driver the shaft. Rotary element 35' also functions as a flywheel, and is disposed in opposing, fluid-tight relation to the stationary element 14. Formed in the inner face of the rotary drive element 35' is a pair of diametrically spaced hemispherical cavities 36', 37' (FIG. 1). The driver flywheel cavities 36', 37' are disposed in opposing and communicating relation to the stationary driver cavities 25', 26', and rotate relative thereto.

Mounted rotatably on the rotary driver element 35' is a pair of diametrically spaced, rotatable paddle-like pistons 40', 41'. One each of the pair of paddle pistons 40', 41' is mounted, respectively, in one of the driver flywheel cavities 36', 37'. The pistons are provided with circumferentially disposed rings or seals similar to the seals 42, 43 for the compressor pistons 40, 41. Pistons 40', 41' are affixed, respectively, to spaced, co-axial radial shafts 44', 49' (FIG. 4) supported rotatably by rotary drive element 35'. The pistons shafts 44', 49' are mounted rotatably on driver flywheel 35' by suitably spaced bearings (not shown) similar to bearings 45, 46, 50, 51 supported by compressor flywheel 35. The inner ends of the piston shafts 44', 49' are provided, respectively, with bevel gears 47', 52' which mesh with the stationary bevel gear 30'. Shaft 11 extends intermediate of the inner ends of the spaced radial shafts 44', 49', and is co-axial with the rotors 35, 35' of the engine 10.

When drive element 35' rotates relative to the stationary element 14, the engagement of piston bevel gears 47', 52' with the stationary bevel gear 30' imparts rotation, via shafts 44', 49', to the paddle pistons 40', 41'. Thus, as the element 35' rotates, the pistons 40', 41' rotate or spin successively into and out of the cavities 25', 26', 36', 37'. These cavities, like the corresponding cavities of the compressor 13, are of complemental concave configuration, to provide suitable clearance, with minimum tolerance, for the revolving paddle-like pistons 40', 41' as the pistons rotate. The sealing rings for the pistons 40', 41' are designed to ensure that a fluid-tight relationship is maintained between the pistons and the internal surfaces of the cavities. By reason of their complemental construction and communicable disposition, the rotary cavities 36', 37' on the one hand, and the stationary cavities 25', 26' on the other hand, together provide separate revolvable chambers or "cylinders" for the rotatable pistons 40', 41', as drive element 35' rotates.

The stationary element 14 is provided with two transversely spaced passageways 70, 72 (FIG. 4) in which are mounted, respectively, spark plugs 71 and 73. The electrode ends of the spark plugs 71, 73 extend, respectively, into the stationary driver cavities 25', 26', to ignite compressed fuel and air mixtures in those cavities. Spent or burned gases are discharged from the cavity 25' by an exhaust system which includes an elongated port 76 providing egress to a passageway 77 formed in, and extending outwardly of, the stationary element 14. Similarly, stationary cavity 26' is provided with an elongated exhaust port 78 leading to an outwardly extending passageway 79 formed in the stationary element 14. Both of the exhaust passageways 77, 79 preferably are connected to suitable means (not shown) for removal of the exhaust gases from the engine 10.

Preferably, the compressor rotor 35 is affixed to shaft 11 at an angular location on the order of 120°-130° in advance of the angular position at which the driver rotor 35' is affixed to the shaft. Thus, the cavities 36', 37' and pistons 40', 41' of rotary element 35' trail the cavities 37, 36 and pistons 41, 40, respectively, of rotary element 35 by an angular displacement on the order of 120°-130° (FIGS. 2, 4). When the pistons 40', 41' of the driver 12 commence a cycle of operation, the pistons 40, 41 of the compressor 13 are approximately 60°-50° from completing their corresponding cycle. In the drawing, the trailing driver pistons 40', 41' are shown as being partially oriented or rotated into their adjacent cavities 36', 37'. Each revolving paddle piston 40, 41, 40', 41' completes one revolution about its axis during each revolution of the rotary elements 35, 36'.

Of course, the angular displacement between the rotary elements or flywheels 35, 35' and their respective pistons and cavities is a matter of choice. It can be varied as necessary or desired, or according to the design of the engine and the nature of the work it is called upon to perform. In the embodiment illustrated, both the compressor pistons 40, 41 and the driver pistons 40', 41' commence their cycles of operation when their radial shafts are horizontal and the pistons are disposed transversely of the engine.

Figure 5:
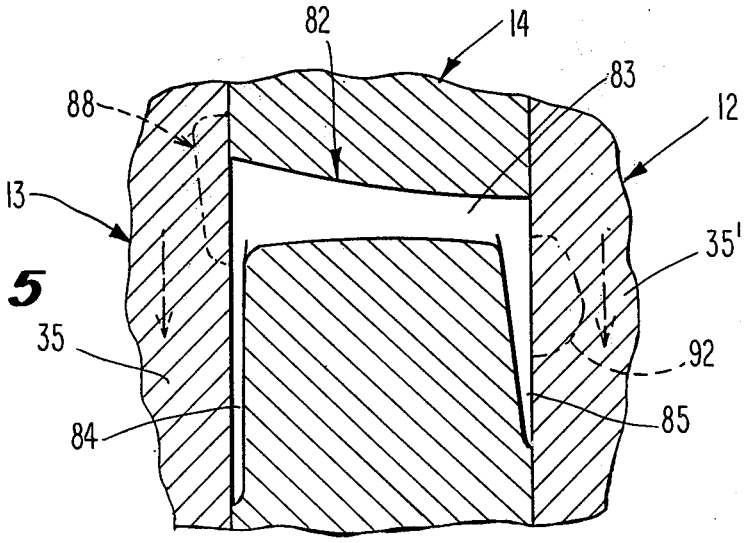
FIG. 5 is an enlarged fragmentary view in section taken as indicated by the arrows V—V of FIG. 4, showing the valve system for the engine.

FIG. 5 illustrates one of the two valve systems interconnecting the compressor unit 13 to the drive unit 12. More specifically, there is illustrated in FIG. 5 a valve system 82 which incorporates a generally longitudinally extending conduit 83 formed in the stationary element 14. On the compressor side, conduit 83 merges into an elongated arcuate slot or port 84 formed in the compressor face of element 14. On the driver side, conduit 83 merges into an elongated arcuate slot or port 85 formed in the driver face of stationary element 14. A second valve system 82' of identical construction is provided on the opposite side of the engine 10 (FIG. 4). It includes conduit 83', a compressor port 84' and a driver port 85' (FIG. 1). During operation of the engine 10, the rotating compressor and drive elements 35, 35' periodically open and close, respectively, the arcuate valve ports 84, 84' and 85, 85'.

The compressor valve ports 84, 84' are located radially outward of both the cavities 25, 26 in element 14, and the cavities 36, 37 in the rotary compressor element 35. Communication between the revolving cavities 36, 37 and the arcuate ports 84, 84' is provided by recess-like conduits 88, 88' (FIG. 2) formed in the inner face of the rotary compressor element 35. The recesses 88, 88' each include elongated slots 89, 89' connected by passages 90, 90' to cavities 36, 37, respectively. The recessed slots 89, 89' are disposed radially outward of cavities 36, 37 so as to coincide with the radial location of the arcuate ports 84, 84'. As compressor element 35 rotates, its arcuate slots 88, 88' periodically engage the arcuate ports 84, 84', to place the valve systems 82, 82' into periodic communication with the revolving piston cavities 36, 37.

Communication between the valve systems 82, 82' and the revolving piston cavities 36', 37' on the driver side of the engine is provided by circumferentially spaced recesses 92, 92' formed in the inner face of the rotary drive element 35' (FIGS. 2, 4). Recesses 92, 92' communicate with the revolving piston cavities 36', 37', respectively. The outer portions of the recesses 92, 92' are disposed so as to rotate into and out of contact with the arcuate valve ports 85, 85' as element 35' rotates, to place the valve systems 82, 82', via recesses 92, 92', into periodic communication with the piston cavities 36', 37'.

Figure 6:
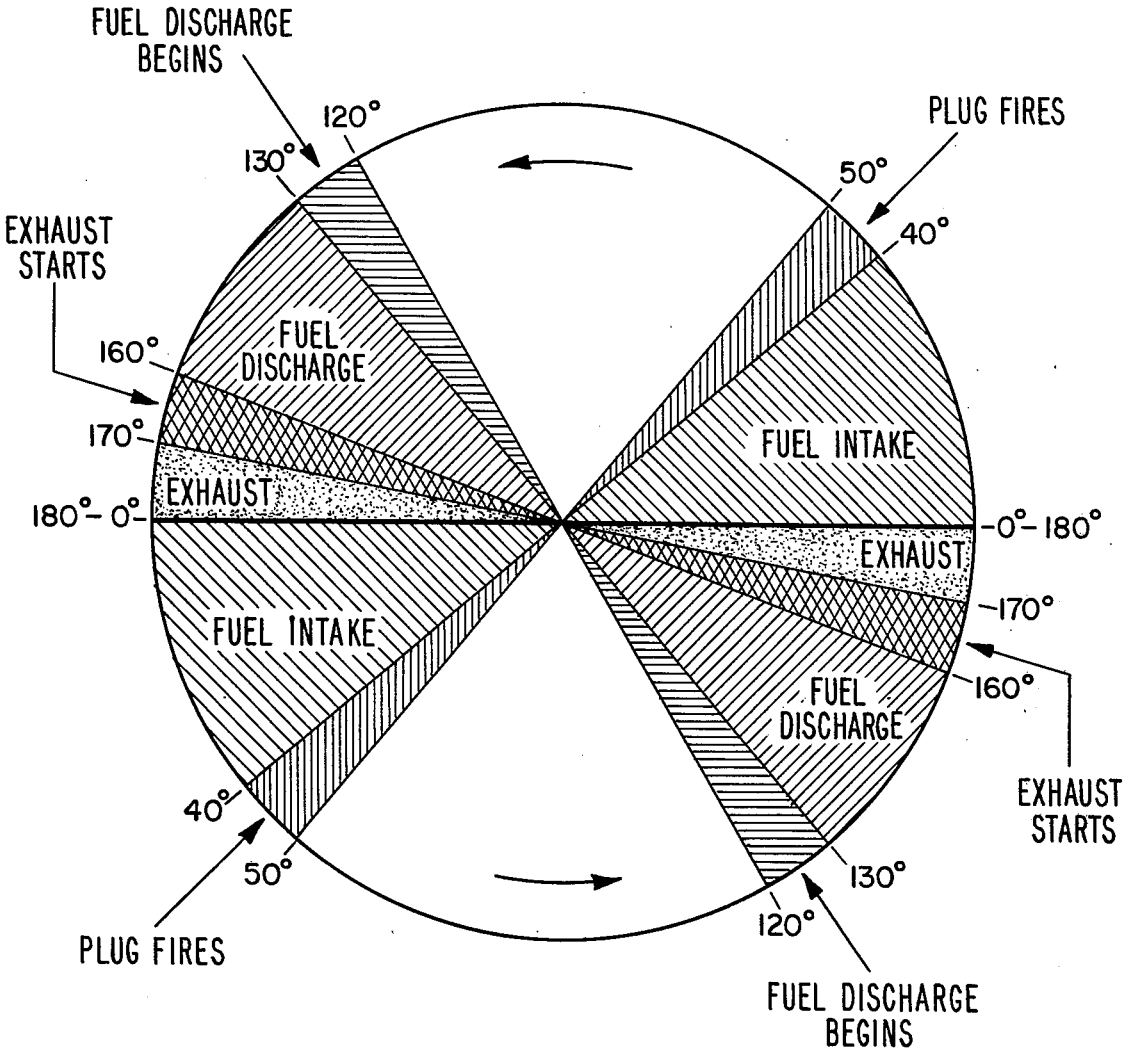
FIG. 6 is a diagram illustrating the cycle of operation of the engine, and showing the angular relationship between the compression side and driver side of the engine and their respective sub-cycles of operation.

FIG. 6 illustrates diagrammatically one full cycle of operation of the engine 10, and also illustrates the respective sub-cycles of the compressor 13 and driver 12. For ease of explanation, the compressor 13 and driver 12 are deemed to complete two sub-cycles of operation during each engine cycle or revolution. An engine cycle and a compressor sub-cycle are deemed to commence at the same time, with the spaced compressor pistons 40, 41 disposed transversely of the engine. This condition of the engine 10 is represented by the horizontal diametric line denoted 0°-180° in FIG. 6.

At the commencement of an engine cycle, a fresh supply of fuel and air mixture, from the carburetor 55, is present in the stationary cavities 25, 26. A supply of the fuel-air mixture also is present in the rotary cavities 36, 37, trapped behind the transversely disposed pistons 40, 41.

As the compressor rotor 35 is rotated by shaft 11, the revolving and rotating paddle pistons 40, 41 spin into their revolving chambers constituted by the cavities 25, 26, 36, 37, to compress the fuel-air mixtures therein. As the pistons 40, 41 rotate about their axes to compress the fuel-air mixtures in their respective cavities, new fuel-air mixtures enter the stationary cavities 25, 26, behind the pistons, from the carburetor 55. If necessary, or desired, a conventional turbo charger may be utilized to force the fresh fuel-air mixture from carburetor 55 into the cavities 25, 26.

In FIGS. 1-4, the compressor rotor 35 is illustrated as having rotated an angular distance of 90° from the start of the engine cycle, and the compressor pistons 40, 41 are shown as having rotated an arcuate distance of 90°. The pistons 40, 41 are fully penetrated into their respective cavities 36, 37, and the fuel-air mixtures are substantially compressed. Further rotation of element 35 and the pistons 40, 41 is required, however, to achieve the desired compression ratio of the fuel-air mixtures in the revolving piston chambers.

In the operation of the engine illustrated in FIGS. 1-6, the desired compression ratio is achieved when the rotor 35 has been rotated an angular distance on the order of 120°-130° from the start of the engine cycle. At this juncture, slots 89, 89' of the rotating recesses 88, 88' in element 35 come into communication with the arcuate slots 84, 84' of the valve systems 82, 82'. The compressed fuel-air mixtures in the revolving piston chambers now are discharged via recesses 88, 88' into the valve systems 82, 82' for delivery to the driver side 12 of the engine. Discharge of the compressed fuel-air mixtures from the revolving chambers continues until the compressor rotor 35 has rotated 180° or a half revolution from the start of the engine cycle. Thereupon, rotor 35 closes valve ports 84, 84', terminating further discharge of the fuel-air mixtures.

At this stage, the compressor pistons 40, 41 also have rotated 180°, to complete their first sub-cycles. Once again, they are disposed transversely of the engine, with their respective radial shafts horizontal. A supply of fuel-air mixture again is trapped behind the pistons in their cavities 36, 37, and a supply of fuel-air mixture is present in the cavities 25, 26. The compressor pistons 40, 41 proceed to carry out the next compressor sub-cycle, during the next half revolution of the rotary compressor element 35.

As indicated previously, driver rotor 35' trails compressor rotor 35 by an angular distance on the order of 120°-130°. Thus, compressor piston 40 and its cavity 36 trail driver piston 40' and its cavity 36' by an angular distance on the order of 60°-50° (FIG. 2). Similarly, compressor piston 41 and its cavity 37 trail driver piston 41' and its cavity 37' by an angular distance on the order of 60°-50°.

The driver sub-cycles of operation commence when the spaced driver pistons 40', 41' are disposed transversely of the engine 10, with their respective radial shafts horizontal, as represented by the horizontal diameter 0°-180° of FIG. 6. As the driver element 35' rotates, the revolving and rotating driver pistons 40', 41' commence spinning into their revolving chambers, preparatory to permitting the chambers to receive a supply of compressed fuel-air mixture from the compressor 13. As soon as the driver sub-cycle commences, recesses 92, 92' in the driver rotor 35' rotate into engagement with the arcuate ports 85, 85' of the valve systems 82, 82', each of which contain a supply of compressed fuel-air mixture from the compressor 13. The valve systems 82, 82' now are opened to the rotary cavities 36', 37' in rotor 35', to discharge the compressed fuel-air mixtures into the revolving chambers at the rear of the rotating driver pistons 40', 41'. Fuel intake by the driver 12 continues until the rotor 35' advances an arcuate distance on the order of 40°-50° from the start of its sub-cycle, whereupon the recesses 92, 92' rotate past the arcuate ports 85, 85'. Rotor 35' now closes the valve systems 82, 82' to terminate further intake of the fuel-air mixture by the revolving driver chambers.

At this point, with the valve systems 82, 82' closed, and the rotor 35' having been advanced angularly on the order of 40°-50°, the spark plugs 71, 73 fire to ignite the fuelair mixtures in the closed chambers behind the driver pistons 40', 41'. The pressure of the expanding gases produced as the result of the combustion generates a propelling force behind the pistons, to drive the rotary driver element 35' to impart rotation to shaft 11. Under the thrust created by the pressure of the gases behind the revolving and rotating pistons, driver element 35' rotates through an additional arcuate distance on the order of 120°, whereupon the elongated exhaust ports 76, 78 are uncovered by the pistons 40', 41'. Element 35' now has rotated an angular distance on the order of 160°-170° from the start of its sub-cycle. The spent burned gases in the revolving driver chambers start to exhaust from the engine through the passageways 77, 79. Exhaust of the spent gases continues until the rotary drive device 35' has completed a half revolution of 180°, and the driver pistons 40', 41' again are disposed transversely of the engine, with their radial shafts horizontal.

At this juncture, the driver pistons have rotated 180° about their axes, to complete their cycles and the first driver sub-cycle. The pistons 40', 41' now are in position to commence the next driver sub-cycle, during the second half revolution of the rotary drive element 35'. As the next driver sub-cycle begins, any exhaust gases trapped in the cavities 36', 37' behind the pistons 40', 41' are swept into the fixed cavities 25', 26', as the pistons begin to spin, and pass through the exhaust ports 76, 78. This occurs while a new supply of compressed fuel-air mixture is drawn into the revolving chambers behind the driver pistons 40', 41'.

The engine 10 continues to operate in repeating cycles and sub-cycles in the manner described. During each such engine cycle, the revolving chambers behind each of the driver pistons 40', 41' twice take on a full charge of compressed fuel-air mixture, each of which is successively ignited by the spark plugs 71, 73 to drive the shaft 11.

It is to be noted, from FIG. 6, that the period of fuel intake on the driver side of the engine is somewhat shorter than the period of fuel discharge on the compressor side. This differential ensures that the fuel-air mixture remains at the selected compression ratio during its transfer to the revolving chambers behind the driver pistons 40', 41'.

It will be understood that the engine 10 is provided with a standard internal combustion engine starter (not shown). If desired, the valve systems 82, 82' may be replaced by conventional cam-lift valves of the type often utilized with gasoline internal combustion engines.

The engine of this invention may be utilized as a diesel engine, in which event the compressor 13 would be utilized to compress air alone for delivery to the driver 12 of the engine. In the case of a diesel engine, the compressor 13 would be designed to produce much higher compression ratios, as is required for such engines. When the invention is utilized as a diesel rotary engine, spark plugs 71, 73 are replaced by conventional fuel injection nozzles of the type normally used, to spray periodically charges of vaporized fuel into the highly compressed air in the revolving chambers disposed behind the engine pistons 40', 41'.

The engine of this invention also is readily adaptable for use as a rotary steam engine. In such event, the compressor 13 is eliminated in favor of usual steam source apparatus. The valve systems 82, 82' are modified as required to provide for the periodic introduction of live steam under high pressure into the revolving chambers disposed behind the driver pistons 40', 41'.

Although a preferred embodiment of this invention has been shown and described for the purpose of illustration, as required by Title 35 U.S.C. Section 112, it is to be understood that various changes and modifications may be made thereto without departing from the spirit and utility of the invention or the scope thereof, as set forth in the appended claims.

I claim:

1. A rotary engine having a power output shaft supported rotatably by a stationary element, and a drive unit for rotating the shaft, said drive unit comprising (a) a rotary drive element affixed to the power output shaft, said rotary element being disposed in opposing relation to the stationary element and being rotatable relative thereto, (b) at least one pair of diametrically spaced, rotatable paddle-like pistons mounted on the rotary drive element, each piston being affixed to a separate shaft supported rotatably by said rotary element, (c) said piston shafts being co-axial, and being disposed radially of the power output shaft, said power output shaft extending intermediate of the piston shafts, (d) drive means connecting each piston shaft to the stationary element, whereby rotation is imparted to the pistons when the rotary drive element rotates relative to the stationary element, (e) a cavity associated with each piston and formed in the rotary drive element and (f) plural cavities associated with the pistons and formed in the stationary element, (g) said rotary drive element cavities and said stationary element cavities being of complemental concave configuration to provide clearance for the pistons as the pistons rotate, whereby each piston rotates into and out of complemental cavities as the rotary drive element rotates relative to the stationary element, (h) said complemental cavities providing drive unit chambers for the reception of a high pressure, expansible fluid for driving the pistons to impart rotation to the rotary drive element and to the power output shaft affixed thereto.

2. The rotary engine of claim 1, wherein (a) the pistons are of generally circular configuration, and are provided with circumferentially mounted sealing means, whereby the pistons engage the drive unit chambers in fluid-tight relationship as the pistons rotate into and out of the complemental cavities which provide the chambers, (b) the shafts of the pistons have inner ends disposed proximate the power output shaft and provided with toothed drive means and (c) toothed drive means affixed to the stationary element meshes with the toothed drive means of the piston shafts to impart rotation to the pistions when the rotary drive element rotates.

3. The rotary engine of claim 1, further including a compressor unit for providing a source of high pressure, expansible fluid, said compressor unit comprising (a) a rotary compressor element affixed to the power output shaft and adapted to be driven by the shaft, said rotary element being disposed in opposing relation to the stationary element and being rotatable relative thereto, (b) at least one rotatable paddle-like piston mounted on the rotary compressor element, said piston being affixed to a shaft supported rotatably by the rotary compressor element, (c) drive means connecting the piston shaft to the stationary element, whereby rotation is imparted to the piston when the rotary compressor element rotates relative to the stationary element, (d) a cavity associated with the piston and formed in the rotary compressor element and (e) plural cavities associated with the piston and formed in the stationary element, (f) said rotary compressor element cavity and said stationary element cavities being of complemental concave configuration to provide clearance for the piston as the piston rotates, whereby the piston rotates into and out of complemental cavities as the rotary compression element rotates relative to the stationary element, (g) said complemental cavities providing compressor unit chambers for the reception and compression of a compressible and expansible fluid for driving the piston of the drive unit.

4. The rotary engine of claim 3, wherein (a) the drive unit and the compressor unit are disposed on opposite sides of the stationary element, (b) the rotary drive element and the rotary compressor element are mounted in fluid-tight relation to the stationary element, (c) a valve system connects the compressor unit chambers to the drive unit chambers, whereby high pressure, expansible fluid is transferred at periodic intervals from the compressor unit to the drive unit, and (d) the rotary drive element and the rotary compressor element are displaced angularly relative to each other, with the rotary drive element trailing the rotary compressor element by a selected angular distance.

5. The rotary engine of claim 4, comprising a gasoline internal combustion engine wherein the fluid is a gasoline and air mixture, and further including (a) a carburetor connected to the compressor unit chamber, for delivery of a gasoline and air mixture to said chambers, and (b) spark plugs associated with the drive unit chambers to ignite the gasoline and air mixtures in said chambers transferred from the compressor unit.

6. The rotary engine of claim 3, wherein (a) the compressor unit includes (i) at least one pair of diametrically spaced, rotatable paddle-like pistons mounted on the rotary compressor element, each piston being affixed to a separate shaft supported rotatably by said rotary element, (ii) said piston shafts being co-axial, and being disposed radially of the power output shaft, said power output shaft extending intermediate of the piston shafts, (iii) drive means connecting each piston shaft to the stationary element, whereby rotation is imparted to the pistons when the rotary compressor element rotates relative to the stationary element, (iv) cavities formed in the rotary compressor element and associated with each piston, said cavities being complemental to the cavities formed in the stationary element to provide a separate revolvable compressor unit chamber for each piston, (b) the drive unit and the compressor unit are disposed on opposite sides of the stationary element, and have their respective rotary elements disposed in fluid-tight relation to the stationary element, (c) a valve system connects the compressor unit chambers to the drive unit chambers, whereby high pressure, expansible fluid is transferred at periodic intervals from the compressor unit to the drive unit, and (d) the rotary drive element and the rotary compressor element are each affixed to the power output shaft, and are displaced angularly on said shaft relative to each other, with the rotary compressor element leading the rotary drive element by a selected angular displacement.

7. A rotary engine having a power output shaft supported rotatably by a stationary element, a drive unit connected to the shaft for imparting rotation thereto and a compressor unit connected to and driven by the shaft for providing a source of high pressure, expansible fluid for the drive unit, said drive and compressor unit being disposed on opposite sides of the stationary element, (a) said drive unit comprising
(i) a rotary drive element affixed to the power output shaft, said rotary element being rotatable relative to the stationary element,
(ii) a rotatable paddle-like piston affixed to a shaft supported rotatably by the rotary element, said shaft being disposed radially relative to the power output shaft,
(iii) drive means connecting the piston shaft to the stationary element, whereby rotation is imparted to the piston when the rotary drive element rotates relative to the stationary element,
(iv) a cavity associated with the piston and formed in the rotary drive element and
(v) plural cavities associated with the piston and formed in the stationary element,
(vi) said rotary drive element cavity and said stationary element cavities being of complemental concave configuration to provide clearance for the piston as the piston rotates, whereby the piston rotates into and out of complemental cavities as the rotary drive element rotates,
(vii) said complemental cavities providing drive unit chambers for the reception of a high pressure, expansible fluid for driving the piston to impart rotation to the rotary drive element and to the rotatable power output shaft affixed thereto;

(b) said compressor unit comprising
(i) a rotary compressor element affixed to the power output shaft and adapted to be driven by the shaft, said rotary element being rotatable relative to the stationary element,
(ii) a rotatable paddle-like piston affixed to a shaft supported rotatably by the rotary compressor element, said shaft being disposed radially relative to the power output shaft,
(iii) drive means connecting the piston shaft to the stationary element, whereby rotation is imparted to the piston when the rotary compressor element rotates relative to the stationary element,
(iv) a cavity associated with the piston and formed in the rotary compressor element and
(v) plural cavities associated with the piston and formed in the stationary element,
(vi) said rotary compressor element cavity and said stationary element cavities being of complemental concave configuration to provide clearance for the piston as the piston rotates, whereby the piston rotates into and out of complemental cavities as the rotary compression element rotates,
(vii) said complemental cavities providing compressor unit chambers for the reception and compression of a compressible and expansible fluid for driving the piston of the drive unit; and (c) a valve system connecting the compressor unit chambers to the drive unit chambers, whereby high pressure, expansible fluid is transferred at periodic intervals from the compressor unit to the drive unit.

8. The rotary engine of claim 7, wherein the rotary drive element and the rotary compressor element are displaced angularly relative to each other, with the rotary drive element trailing the rotary compressor element by a selected angular distance.

9. The rotary engine of claim 7, comprising a gasoline internal combustion engine wherein the fluid is a gasoline and fuel mixture, and further including (a) a carburetor connected to the compressor unit chambers, for delivery of a gasoline and air mixture to said chambers, and
(b) sparkplugs associated with the drive unit chambers to ignite the gasoline and air mixtures transferred from the compressor unit to said drive unit chambers.

10. A rotary engine having a power output shaft supported rotatably by a stationary element, a drive unit for imparting rotation to the shaft and a compressor unit driven by the shaft for providing a source of high pressure, expansible fluid for the drive unit, said stationary element being disposed intermediate the drive unit and the compressor unit, (a) said drive unit comprising
(i) a rotary drive element affixed to the power output shaft, said drive element being rotatable relative to the stationary element,
(ii) at least one paddle-like piston mounted rotatably on the drive element, said piston having its axis of rotation disposed radially relative to the power output shaft,
(iii) drive means connecting the piston to the stationary element, whereby rotation is imparted to the piston when the drive element rotates,
(iv) a cavity associated with the piston and formed in the drive element and
(v) at least one cavity associated with the piston and formed in the stationary element,
(vi) said drive element and stationary element cavities being juxtaposed axially relative to the power output shaft for periodic communication with each other as the drive element rotates, and having complemental concave configurations to provide clearance for the piston as the piston rotates,
(vii) said complemental cavities providing a drive unit chamber for the reception of a high pressure, expansible fluid for driving the piston to impart rotation to the rotary drive element and to the rotatable power output shaft affixed thereto;

(b) said compressor unit comprising
(i) a rotary compressor element affixed to the power output shaft and adapted to be driven by the shaft, said compressor element being rotatable relative to the stationary element,
(ii) at least on paddle-like piston mounted rotatably on the compressor element, said piston having its axis of rotation disposed radially relative to the power output shaft, (iii) drive means connecting the piston to the stationary element, whereby rotation is imparted to the piston when the compressor element rotates, (iv) a cavity associated with the piston and formed in the compressor element and (v) at least one cavity associated with the piston and formed in the stationary element, (vi) said compressor element and stationary element cavities being juxtaposed axially relative to the power output shaft for periodic communication with each other as the compressor element rotates, and having complemental concave configurations to provide clearance for the piston as the piston rotates, (vii) said complemental cavities providing a compressor unit chamber for the reception and compression of a compressible and expansible fluid for driving the piston of the drive unit; and (c) a valve system connecting the compressor unit chamber to the drive unit chamber, whereby high pressure, expansible fluid is transferred at periodic intervals from the compressor unit to the drive unit.

* * * * *